US008057240B2

(12) United States Patent
Morgan

(10) Patent No.: US 8,057,240 B2
(45) Date of Patent: Nov. 15, 2011

(54) CIRCUIT BOARD FOR AN ELECTRICAL CONNECTOR ASSEMBLY

(75) Inventor: Chad William Morgan, Woolwich Township, NJ (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/729,984

(22) Filed: Mar. 23, 2010

(65) Prior Publication Data

US 2011/0237091 A1 Sep. 29, 2011

(51) Int. Cl.
*H01R 12/00* (2006.01)

(52) U.S. Cl. ..... 439/55

(58) Field of Classification Search ..... 439/55, 439/83, 601.01, 601.09, 601.11
See application file for complete search history.

(56) References Cited

U.S. PATENT DOCUMENTS 3,076,164 A * 1/1963 Ullman et al. ..... 439/55
3,337,838 A * 8/1967 Damiano et al. ..... 439/295
3,444,506 A * 5/1969 Wedekind ..... 439/405
3,491,197 A * 1/1970 Walkow ..... 174/254
3,875,479 A * 4/1975 Jaggar ..... 361/792
4,787,853 A * 11/1988 Igarashi ..... 439/55
4,859,195 A * 8/1989 Steiner ..... 439/55
4,943,846 A * 7/1990 Shirling ..... 257/697
5,042,146 A * 8/1991 Watson ..... 29/845
5,069,626 A * 12/1991 Patterson et al. ..... 439/55
5,309,024 A * 5/1994 Hirano ..... 257/773
5,326,936 A * 7/1994 Taniuchi et al. ..... 174/260
5,543,586 A 8/1996 Crane, Jr. et al.
5,926,375 A * 7/1999 Watanabe et al. ..... 361/760
6,443,739 B1 * 9/2002 Currie ..... 439/55
6,453,549 B1 * 9/2002 Bhatt et al. ..... 29/837
6,651,322 B1 * 11/2003 Currie ..... 29/840
6,659,423 B1 * 12/2003 Dauvergne et al. ..... 251/129.11
6,817,870 B1 * 11/2004 Kwong et al. ..... 439/74
6,963,494 B2 * 11/2005 Mickievicz et al. ..... 361/795
7,218,530 B2 * 5/2007 Mickievicz et al. ..... 361/795
7,833,026 B1 * 11/2010 Morgan et al. ..... 439/108
2007/0169961 A1 7/2007 Kwong et al.
2007/0202747 A1 * 8/2007 Sharf et al. ..... 439/608
2008/0207015 A1 8/2008 Sueyoshi
2008/0248658 A1 * 10/2008 Cohen et al. ..... 439/55
2008/0248659 A1 * 10/2008 Cohen et al. ..... 439/59
2010/0015822 A1 * 1/2010 Morgan et al. ..... 439/83

* cited by examiner

*Primary Examiner* — Tulsidas C Patel
*Assistant Examiner* — Vladimir Imas

(57) ABSTRACT

An electrical connector assembly includes an electrical connector having a mounting face and signal terminals extending from the mounting face. The electrical connector assembly also includes a circuit board having an upper surface and a lower surface with vias extending at least partially through the circuit board along parallel via axes. The vias are at least partially filled with conductive material to create signal columns, wherein the signal terminals are set in corresponding signal columns. The signal terminals are electrically connected to the signal columns.

23 Claims, 3 Drawing Sheets

CIRCUIT BOARD FOR AN ELECTRICAL CONNECTOR ASSEMBLY

BACKGROUND OF THE INVENTION

The subject matter described and/or illustrated herein relates generally to electrical connector systems and, more particularly, to electrical connectors that are mounted on circuit boards.

To meet digital multi-media demands, higher data throughput is often desired for current digital communications equipment. Electrical connectors that interconnect circuit boards must therefore handle ever increasing signal speeds at ever increasing signal densities. One application environment that uses such electrical connectors is in high speed, differential electrical connectors, such as those common in the telecommunications or computing environments. In a traditional approach, two circuit boards are interconnected with one another in a backplane and a daughter board configuration. However, at the footprints of the circuit boards where the electrical connectors connect thereto it may be difficult to improve density while maintaining electrical performance and/or reasonable manufacturing cost. For example, vias within the circuit boards must be large enough to plate for a given circuit board thickness, but must also be far enough apart from one another to maintain electrical performance (e.g., impedance and/or noise). To increase the number of vias, and therefore increase the density of the circuit board footprint, the vias can be smaller and/or closer together. However, moving the vias closer together degrades the electrical performance of the circuit board footprint, while decreasing the size of the vias may increase manufacturing costs by increasing the difficulty of plating the vias. Circuit board footprints are currently a bottleneck for achieving higher system densities and/or higher system speeds.

There is a need for an electrical connector that enables improvement of the density and/or electrical performance of circuit board footprints to achieve higher system densities and/or higher system speeds.

BRIEF DESCRIPTION OF THE INVENTION

In one embodiment, an electrical connector assembly is provided that includes an electrical connector having a mounting face and signal terminals extending from the mounting face. The electrical connector assembly also includes a circuit board having an upper surface and a lower surface with vias extending at least partially through the circuit board along parallel via axes. The vias are at least partially filled with conductive material to create signal columns, wherein the signal terminals are set in corresponding signal columns. The signal terminals are electrically connected to the signal columns.

In another embodiment, an electrical connector assembly is provided including an electrical connector having a mounting face and signal terminals extending from the mounting face. The electrical connector assembly also includes a circuit board having an upper surface and a lower surface with vias extending at least partially through the circuit board along parallel via axes. The vias are at least partially filled with conductive material to create signal columns extending from a column top to a column bottom. The column bottom is elevated above the lower surface. The signal terminals are set in corresponding signal columns and are electrically connected to the signal columns.

In a further embodiment, an electrical connector assembly is provided including a circuit board having an upper surface and a lower surface. The circuit board includes vias extending at least partially through the circuit board along parallel via axes. Signal columns are provided within corresponding vias. Each signal column includes a conductive material placed within the corresponding via in a fluid or semi-fluid state. The signal column are configured to receive a corresponding signal terminal when the conductive material is in the fluid or semi-fluid state, and the conductive material is thereafter set to a solid state.

DETAILED DESCRIPTION OF THE INVENTION

Figure 1:
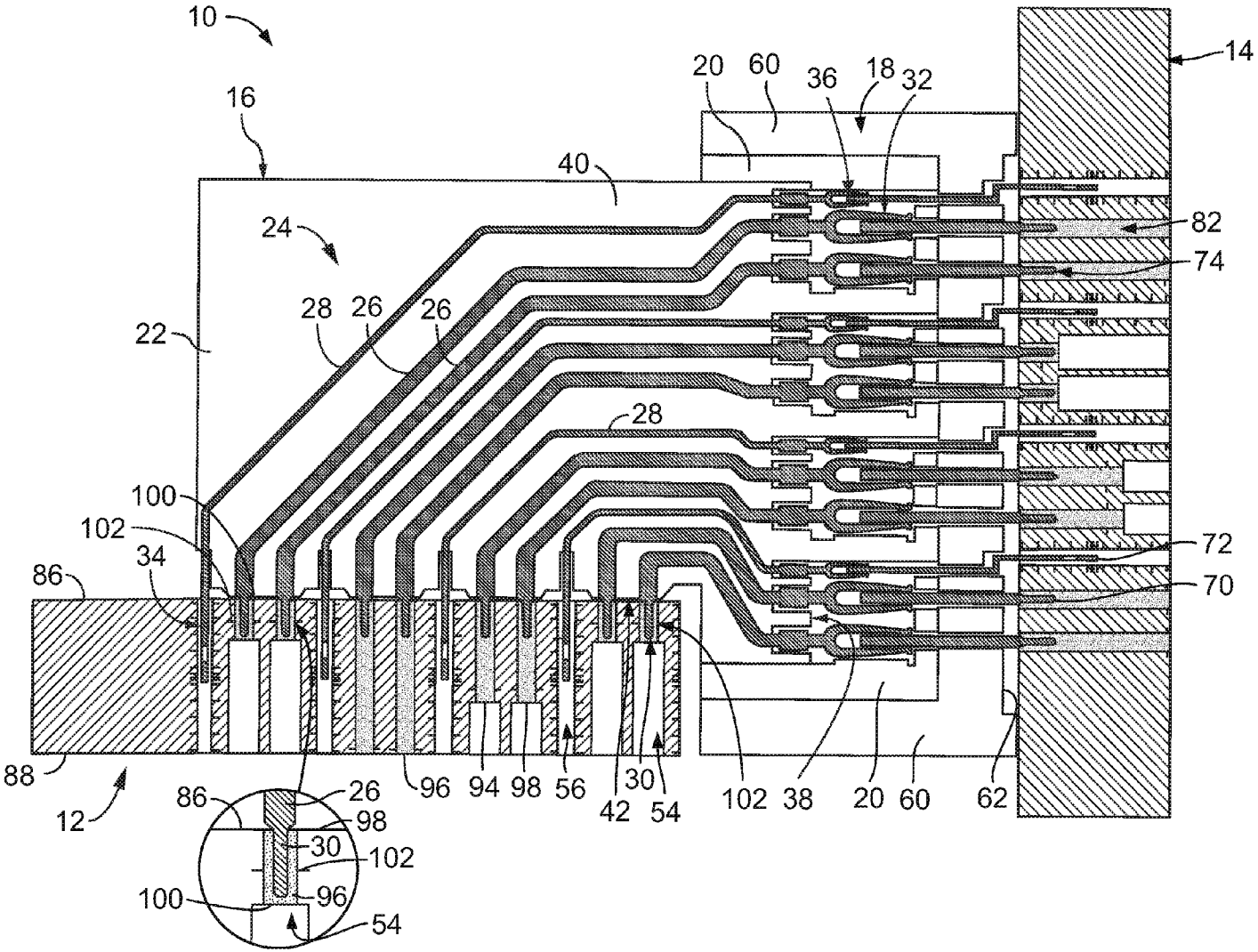
FIG. 1 is a cross-sectional view of an exemplary embodiment of an electrical connector assembly illustrating electrical connectors mounted to circuit boards.

FIG. 1 is a cross-sectional view of an exemplary embodiment of an electrical connector assembly 10. The connector assembly 10 includes a pair of circuit boards 12 and 14, a receptacle connector 16, and a header connector 18. The receptacle connector 16 is mounted on the circuit board 12, and the header connector 18 is mounted on the circuit board 14. The receptacle connector 16 and the header connector 18 are connected together to electrically connect the circuit boards 12 and 14. In the exemplary embodiment of FIG. 1, the receptacle connector 16 and the header connector 18 are oriented such that the connectors 16 and 18 form an approximate right-angle connection between the circuit boards 12 and 14. Alternatively, the receptacle connector 16 and the header connector 18 may be oriented such that the circuit boards 12 and 14 are oriented at any other angle relative to each other, such as, but not limited to approximately parallel. The subject matter herein may be described with reference to either the circuit board 12 or the circuit board 14, however it is realized that features or elements described relative to one of the circuit boards 12 or 14 may apply equally to the other circuit board 12 or 14. Similarly, the subject matter herein may be described with reference to either the receptacle connector 16 or the header connector 18, however it is realized that features or elements described relative to one of the receptacle connector 16 or the header connector 18 may apply equally to the other of the receptacle connector 16 or the header connector 18.

The receptacle connector 16 includes a dielectric housing 20 that, in the illustrated embodiment, holds a plurality of parallel contact modules 22 (one of which is illustrated in FIG. 1). The contact module 22 includes a contact lead frame 24 that includes a plurality of signal terminals 26 and/or a plurality of ground terminals 28. Each signal terminal 26 includes a mounting contact 30 at one end portion of the signal terminal 26 and a mating contact 32 at an opposite end portion of the signal terminal 26. Similarly, each ground terminal 28 includes a mounting contact 34 at one end portion of the ground terminal 28 and a mating contact 36 at an opposite end portion of the ground terminal 28. The mating contacts 32 and 36 extend outward from, and along, a mating lace 38 of the contact module 22. The signal terminals 26 are optionally arranged in differential pairs.

Each contact module 22 includes a dielectric contact module housing 40 that holds the corresponding lead frame 24. Each contact module housing 40 includes the mating face 38 and a mounting face 42. In the illustrated embodiment, the mating face 38 is approximately perpendicular to the mounting face 42. However, the mating face 38 and mounting face 42 may be oriented at any other angle relative to each other, such as, but not limited to, approximately parallel. The mating face 38 of each contact module 22 is received in the housing 20 and is configured to mate with corresponding mating contacts of the header connector 18.

The mounting face 42 of each of the contact modules 22 is configured for mounting on a circuit hoard, such as, but not limited to, the circuit board 12. The mounting contacts 30 and 34 extend outward from, and along, the mounting face 42 of the contact modules 22 for mechanical and electrical connection to the circuit board 12. Specifically, each of the mounting contacts 30 and 34 is configured to be received within a corresponding via 54 and 56, respectively, within the circuit board 12.

In an exemplary embodiment, the mounting contacts 30 constitute pins extending from the mounting face 42. However, signal terminals 26 having other types of mounting contacts 30 may be used in alternative embodiments. For example, the signal terminals 26 may be variable depth connection terminals, such as the terminals described in U.S. patent application Ser. No. 12/729,889 titled "ELECTRICAL CONNECTOR SYSTEM", the complete subject matter of which is incorporated by reference herein. Variable depth connection terminals generally have the mounting contacts 30 extend different lengths from the mounting face 42 than others of the mounting contacts 30. In the illustrated embodiment, the mounting contacts 30 extend the same lengths from the mounting face 42. In an exemplary embodiment, the mounting contacts 30 are simple pins having a generally rectangular shape. In other embodiments, the mounting contacts 30 may have enlarged portions representing eye-of-the-needle portions. The enlarged portions may be used to hold the mounting contacts 30 in the vias 54.

The header connector 18 includes a dielectric housing 60 that receives the receptacle connector 16 and a mounting face 62 for mounting the header connector 18 to a circuit board, such as, but not limited to the circuit board 14. The housing 60 holds a plurality of signal terminals 70 and a plurality of ground terminals 72. The signal terminals 70 are optionally arranged in differential pairs, as the signal terminals 70 are shown in the illustrated embodiment.

Each signal terminal 70 includes a mounting contact 74 at one end portion of the signal terminal 70. Each of the mounting contacts 74 is configured to be received within a corresponding via 82 within the circuit board 14. Optionally, each of the mounting contacts 74 may extend the same depth into the vias 82. Alternatively, some of the mounting contacts 74 of the signal terminals 70 may extend different lengths from the mounting face 62 of the header connector 18 than others of the mounting contacts 74.

The circuit board 12 includes a substrate having a pair of opposite upper and lower surfaces 86 and 88. The mounting face 42 of each of the contact modules 22 is configured to be mounted along the upper surface 86 such that the receptacle connector 16 is mounted on the upper surface 86 of the circuit board 12. The circuit board 12 includes the plurality of vias 54 and 56 that receive the mounting contacts 30 and 34, respectively, of the respective signal and ground terminals 26 and 28. The circuit board 14 may be formed in a similar manner as the circuit board 12.

The vias 54 each include an inner surface 94, which may be formed during a boring process or a laser drilling process. Optionally, the inner surface 94 may be cylindrical and may have the same diameter throughout the circuit board 12 from the upper surface 86 to the lower surface 88. Alternatively, the inner surface may have different portions of different diameters. In some embodiments, the vias 54 may not extend entirely through the circuit board 12, but instead extend only partially through the circuit board 12 from the upper surface 86 to an area below a mounting pad 102 associated with the via 54.

The vias 54 are at least partially tilled with conductive material to create signal columns 96. The signal columns 96 extend between a column top 98 and a column bottom 100. The column top 98 may be recessed below the upper surface 86. The column bottom 100 may be recessed from the lower surface 88 at a depth above the lower surface 88. The signal columns 96 pass though corresponding mounting pads 102 in, or on, one of the layers. The mounting pads 102 are connected to corresponding signal traces (not shown) routed through the circuit board 12. The mounting pads 102 define the connection point between the receptacle connector 16 (shown in FIG. 1) and the circuit board 12. The engagement between the signal columns 96 and the mounting pads 102 create an electrical connection between the signal columns 96 and the mounting pads 102.

The signal columns 96 generally fill the volume of the vias 54, as opposed to being hollow and lining the vias 54, such as when the vias 54 are plated. In an exemplary embodiment, the conductive material constitutes a solder paste that at least partially fills the corresponding via 54. The solder paste may be loaded into the via 54 in a fluid or semi-fluid state. The solder paste may then set and harden to a solid state. The solder paste may be reflowed to a fluid or semi-fluid state after hardening. In an alternative embodiment, the conductive material constitutes a conductive epoxy that at least partially fills the corresponding via 54. The epoxy may be loaded into the via 54 in a fluid or semi-fluid state. The epoxy may then cure and harden to a solid state. Alternatively, the epoxy may remain in a non-solid state.

During assembly, when the receptacle connector 16 is mounted to the circuit board 12, the mounting contacts 30 of the signal terminals 26 are received in the vias 54 such that the mounting contacts 30 are embedded within the signal columns 96. When the mounting contacts 30 engage the signal columns 96, an electrical path is created between the mounting contacts 30 and the mounting pads 102.

Figure 2:
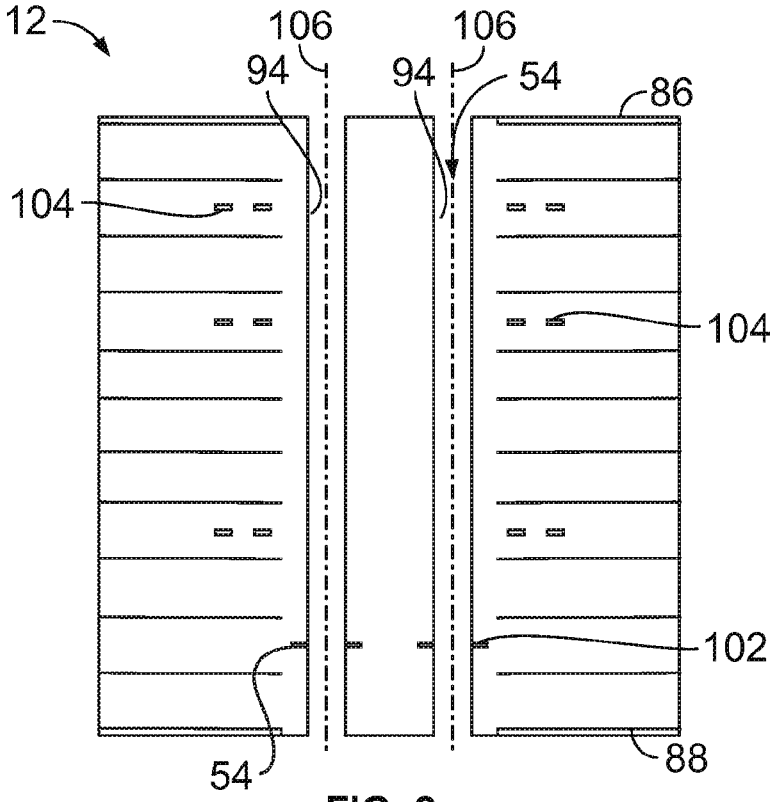
FIG. 2 is a partial cut-away view of one of the circuit boards during one stage of manufacture.
Figure 3:
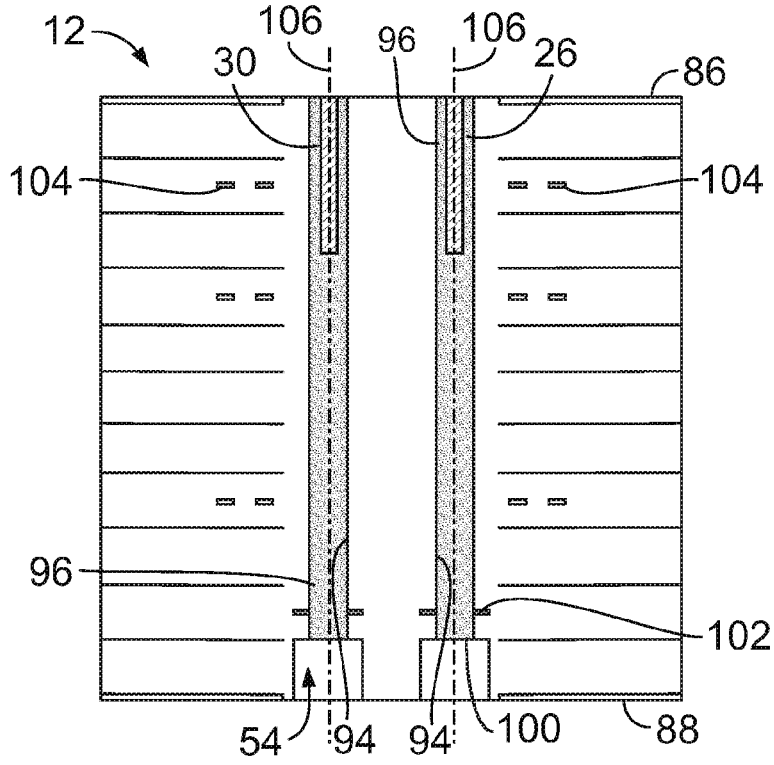
FIG. 3 is a partial cut-away view of the circuit board shown in FIG. 2 during another stage of manufacture.

FIG. 2 is a partial cut-away view of the circuit board 12 during one stage of manufacture prior to the signal columns 96 being loaded into the vias 54. FIG. 3 is a partial cut-away view of the circuit board 12 during another stage of manufacture after the signal columns 96 are loaded into the vias 54.

The circuit board 12 includes a pair of the vias 54 extending through the layers of the circuit board 12 between the upper and lower surfaces 86, 88. The thickness of the circuit board 12 is a function of the number of layers, and the number of layers may depend, at least in part, on the number of components being connected to the circuit board 12. For example, a backplane circuit board may be substantially thicker than a daughtercard circuit board because many more electrical components are connected to the backplane circuit board as compared to the daughtercard circuit board, thus more layers are required to route the traces through the board.

In an exemplary embodiment, the vias 54 are formed by boring through the circuit board 12 at predetermined locations, such that the bore passes though corresponding mounting pads 102 in, or on, one of the layers. The mounting pads 102 are connected to corresponding signal traces (not shown) routed through the circuit board 12. Boring through the circuit board 12 forms the surface 94, which is cylindrical and has a certain diameter. Because the vias 54 are generally filled with the conductive material, as opposed to being lined with a plating layer, the diameters of the vias 54 may be smaller than vias of circuit boards that are to be plated. Vias that are plated must maintain certain aspect ratios of circuit board thickness to via diameter in order to facilitate adequate plating of the via. If the diameters of the vias to be plated are too small, as compared to the thickness of the circuit board 12, then the via cannot be properly plated as the plating material may not flow through the via. In the illustrated embodiment, because the vias 54 may have relatively small diameters, the vias 54 provide advantages compared to plated vias. For example, the vias 54 may be further away from neighboring traces 104 in the circuit board 12 without a reduction in via density, that is, without a reduction in the number of vias per unit area. The vias 54 may be arranged advantageously to control impedance and other electrical characteristics.

As shown in FIG. 3, once the vias 54 are bored, the conductive material is loaded into the vias 54, such as by an injection process. The conductive material substantially tills the volume of the vias 54 and displaces the air in the vias 54 with the conductive material. The signal columns 96 have a cylindrical shape that is tilled without substantial voids or cavities therein. After the conductive material is in the vias 54, the mounting contacts 30 may be mounted into the conductive material in the vias 54. For example, while the conductive material is still in the fluid or semi-fluid state, or brought back to a fluid or semi-fluid state by a reflow process or other process, the mounting contacts 30 may be set therein such that the conductive material completely surrounds the mounting contacts 30. The mounting contacts 30 displace some of the conductive material when set therein. The mounting contacts 30 need not be forced against the surface 94, such as in a press-fit arrangement. Rather, just having the mounting contacts 30 embedded in the signal column 96 is enough to ensure an electrical connection is defined therebetween. Additionally, after the conductive material sets or hardens, the mounting contacts 30 are held within the vias 54.

The mounting contacts 30 represented in FIG. 3 are simple pins having a generally rectangular cross-section. The mounting contacts 30 are smaller than the diameter of the vias 54 such that the edges of the mounting contacts 30 are held away from the sides of the vias 54. As such, the mounting contacts 30 do not encounter much resistance during loading into the vias 54, which helps prevent buckling. The mounting contacts 30 are relatively short, as compared to the overall length of the vias 54. The signal columns 96 extend between the mounting contacts 30 and the corresponding mounting pads 102.

Having the signal columns 96 in proximity to other traces 104 routed through the various layers of the circuit board 12 has a negative impact on the electrical performance of the system. For example, signal degradation due to cross-talk between the signal columns 96 and the traces 104 may result. The effects of the signal degradation may be impacted by the characteristics of the signals being transmitted by the signal columns 96 and/or the traces 104, such as, but not limited to, the signal transmission speed. In an exemplary embodiment, at least a portion of each signal column 96 is removed during a counterboring process to reduce the length of the signal column 96 along a via axis 106 thereof, such as illustrated in FIG. 3.

In an exemplary embodiment, a portion of the signal column 96 is removed during a counterboring operation. The vias 54 are counterbored from the lower surface 88 to the vicinity of the mounting pads 102. The column bottom 100 is at a depth above the lower surface 88. The counterboring reduces parasitic capacitance that can degrade overall system performance substantially. Counterboring from the upper surface 86 may also be possible after loading the conductive material, but prior to mounting the mounting contacts 30 to the circuit board 12.

Figure 4:
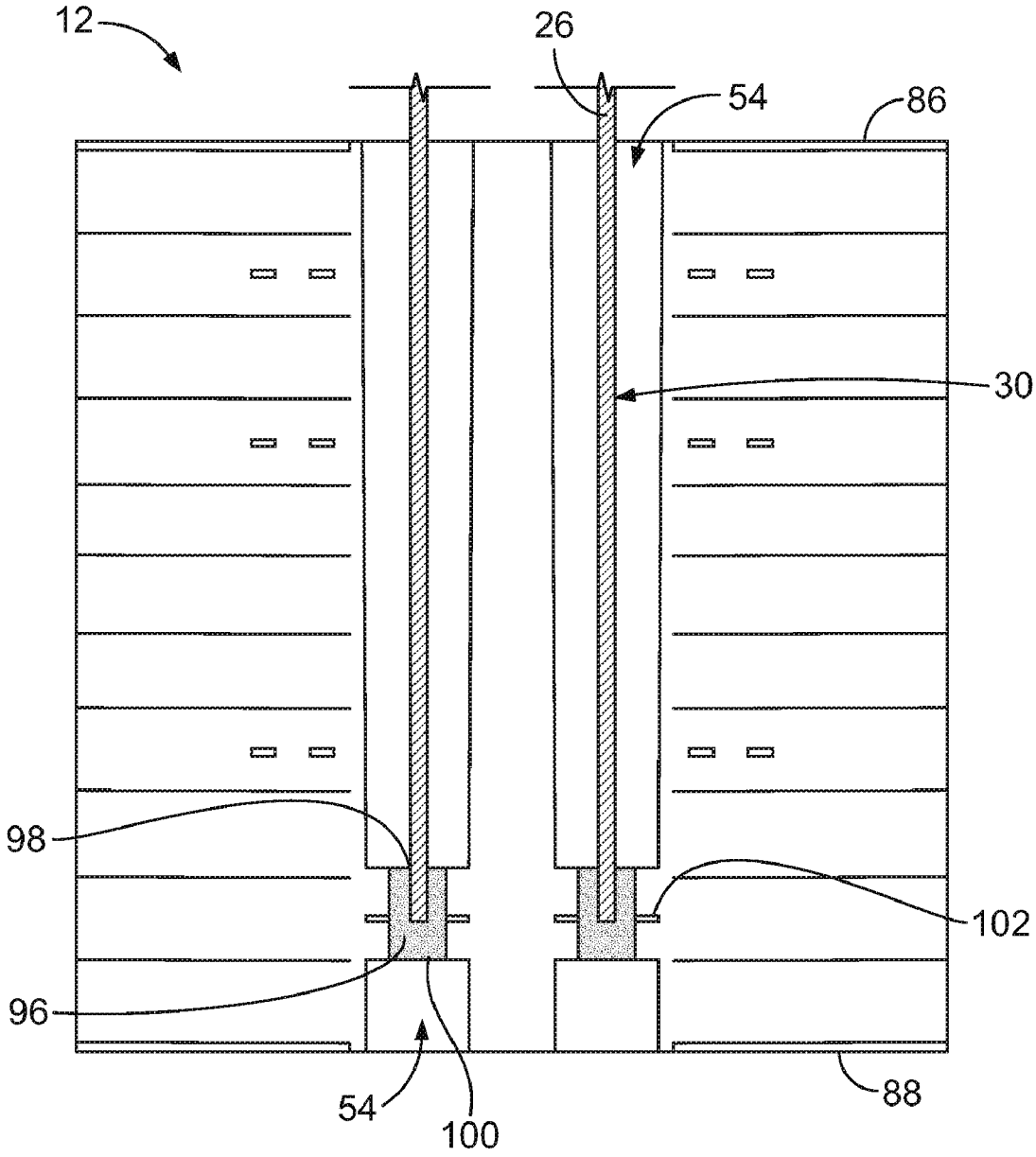
FIG. 4 is a partial cut-away view of the circuit board shown in FIG. 2 during another stage of manufacture.

FIG. 4 is a partial cut-away view of the circuit board 12 showing the circuit board 12 counterbored from the upper surface 86. The counterboring from the upper surface 86 removes another portion of the signal column 96, making the signal column 96 shorter. The column top 98 is recessed below the upper surface 86. The counterboring may occur either before or after the conductive material of the signal columns 96 hardens. If done after hardening, the signal columns 96 may be reflowed or otherwise returned to a state that would accept the mounting contacts 30.

In embodiments using counterboring of the tops of the signal columns 96, variable length mounting contacts 30 may be employed. For example, mounting contacts 30 having lengths that are substantially equal to the depths of the mounting pads 102 from the upper surface 86 may be used. As such, the signal columns 96 may be counterbored to the vicinity of the mounting pads 102, making the signal columns 96 relatively short in length, which may affect the signal integrity of the circuit board 12, such as by improving impedance and/or reducing cross-talk.

The embodiments described and/or illustrated herein provide an electrical connector that may enable improvement of the density and/or electrical performance of circuit board footprints to achieve higher system densities and/or higher system speeds. For example, the embodiments described and/or illustrated herein, when left at the same density as at least some known systems, may decrease via to via coupling and may increase circuit board footprint impedance. Alternatively, the embodiments described and/or illustrated herein may be able to achieve higher footprint densities than at least some known systems while maintaining the same via to via coupling and impedance levels of such known systems. The embodiments described and/or illustrated herein may provide improved electrical characteristics between signal terminals of the electrical connector.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

an electrical connector having a mounting face, the electrical connector having signal terminals extending from the mounting face; and a circuit board having an upper surface and a lower surface, the circuit board comprising signal traces routed through the circuit board, the signal traces having mounting pads defining connection points of the signal traces, the circuit board comprising non-plated vias extending at least partially through the circuit board along parallel via axes, the non-plated vias extending through the mounting pads exposing the mounting pads to corresponding voids defined by the non-plated vias, wherein the non-plated vias are at least partially filled with conductive material to create signal columns, the signal columns engaging the exposed mounting pads of the signal traces to electrically connect the signal columns to the corresponding signal traces, wherein the signal terminals are set in corresponding signal columns, the signal terminals being electrically connected to the signal columns.

2. The assembly of claim 1, wherein the conductive material is placed within the corresponding via in a fluid or semi-fluid state, the signal column receiving the corresponding signal terminal when the conductive material is in the fluid or semi-fluid state, and the conductive material being thereafter set to a solid state.

3. The assembly of claim 1, wherein each signal column extends from a column top to a column bottom, the column bottom being elevated above the lower surface.

4. The assembly of claim 1, wherein each signal column extends from a column top to a column bottom, the signal column entirely filling the corresponding via between the column top and the column bottom.

5. The assembly of claim 1, wherein the conductive material comprises a solder paste filling at least an upper portion of the via, the signal terminal being set in the solder paste when the solder paste is in a fluid or semi-fluid state.

6. The assembly of claim 1, wherein the conductive material comprises a conductive epoxy filling at least an upper portion of the via, the signal terminal being set in the conductive epoxy prior to the conductive epoxy being cured.

7. The assembly of claim 1, wherein each signal column extends from a column top to a column bottom, the column bottom being counterbored to a depth above the lower surface of the circuit board.

8. The assembly of claim 1, wherein the signal columns are counterbored from at least one of the upper surface and the lower surface to the vicinity of the corresponding mounting pad.

9. An electrical connector assembly comprising:

an electrical connector having a mounting face, the electrical connector having signal terminals extending from the mounting face; and a circuit board having an upper surface and a lower surface, the circuit board comprising signal traces routed through the circuit board, the signal traces having mounting pads defining connection points of the signal traces, the circuit board comprising non-plated vias extending at least partially through the circuit board along parallel via axes, the non-plated vias extending through the mounting pads exposing the mounting pads to corresponding voids defined by the non-plated vias, wherein the non-plated vias are at least partially filled with conductive material to create signal columns, the signal columns engaging the exposed mounting pads of the signal traces to electrically connect the signal columns to the corresponding signal traces, the signal columns extending from a column top to a column bottom, the column bottom being elevated above the lower surface, wherein the signal terminals are set in corresponding signal columns, the signal terminals being electrically connected to the signal columns.

10. The assembly of claim 9, wherein the column bottom is counterbored from the lower surface of the circuit board to a depth above the lower surface.

11. The assembly of claim 9, wherein the signal columns are counterbored from the lower surface to the vicinity of the corresponding mounting pad.

12. The assembly of claim 9, wherein the conductive material is placed within the corresponding via in a fluid or semi-fluid state, the signal column receiving the corresponding signal terminal when the conductive material is in the fluid or semi-fluid state, and the conductive material being thereafter set to a solid state.

13. The assembly of claim 9, wherein the signal column entirely fills the corresponding via between the column top and the column bottom.

14. The assembly of claim 9, wherein the signal terminals include mounting portions, the signal columns entirely surrounding the mounting portions of the corresponding signal terminals.

15. The assembly of claim 9, wherein the conductive material comprises a solder paste filling at least an upper portion of the via, the signal terminal being set in the solder paste when the solder paste is in a fluid or semi-fluid state.

16. The assembly of claim 9, wherein the conductive material comprises a conductive epoxy filling at least an upper portion of the via, the signal terminal being set in the conductive epoxy prior to the conductive epoxy being cured.

17. An electrical connector assembly comprising:

a circuit board having an upper surface and a lower surface, the circuit board comprising signal traces routed through the circuit board, the signal traces having mounting pads defining connection points of the signal traces, the circuit board comprising non-plated vias extending at least partially through the circuit board along parallel via axes, the non-plated vias extending through the mounting pads exposing the mounting pads to corresponding voids defined by the non-plated vias; and signal columns within corresponding vias, each signal column comprising a conductive material placed within the corresponding via in a fluid or semi-fluid state, the signal columns engaging the exposed mounting pads of the signal traces to electrically connect the signal columns to the corresponding signal traces, the signal column being configured to receive a corresponding signal terminal when the conductive material is in the fluid or semi-fluid state, the conductive material being thereafter set to a solid state.

18. The assembly of claim 17, wherein the conductive material comprises a solder paste filling at least an upper portion of the via, the signal terminal being set in the solder paste when the solder paste is in a fluid or semi-fluid state.

19. The assembly of claim 17, wherein the conductive material comprises a conductive epoxy filling at least an upper portion of the via, the signal terminal being set in the conductive epoxy prior to the conductive epoxy being cured.

20. The assembly of claim 17, wherein each signal column extends from a column top to a column bottom, the signal column entirely filling the corresponding via between the column top and the column bottom.

21. The assembly of claim 17, wherein the circuit board includes non-conductive circuit board material extending along the non-plated vias, each signal column engaging the non-conductive circuit board material.

22. The assembly of claim 1, wherein the circuit board includes non-conductive circuit board material extending along the non-plated vias, each signal column engaging the non-conductive circuit board material.

23. The assembly of claim 9, wherein the circuit board includes non-conductive circuit board material extending along the non-plated vias, each signal column engaging the non-conductive circuit board material.

* * * * *